US011850637B2

(12) United States Patent
Macomber

(10) Patent No.: US 11,850,637 B2
(45) Date of Patent: Dec. 26, 2023

(54) ROTARY DEVICES AND RELATED METHODS

(71) Applicant: Lance Richard Macomber, West Palm Beach, FL (US)

(72) Inventor: Lance Richard Macomber, West Palm Beach, FL (US)

( * ) Notice: Subject to any disclaimer, the term of this patent is extended or adjusted under 35 U.S.C. 154(b) by 834 days.

(21) Appl. No.: 16/929,102

(22) Filed: Jul. 14, 2020

(65) Prior Publication Data

US 2021/0001386 A1 Jan. 7, 2021

Related U.S. Application Data

(63) Continuation-in-part of application No. 16/046,568, filed on Jul. 26, 2018, now Pat. No. 10,709,231.

(60) Provisional application No. 62/537,081, filed on Jul. 26, 2017.

(51) Int. Cl.

| | |
|---|---|
| ***B08B 9/087*** | (2006.01) |
| ***A47L 17/00*** | (2006.01) |
| *B08B 1/04* | (2006.01) |
| *A46B 13/08* | (2006.01) |

(52) U.S. Cl.

CPC ..... *B08B 9/087* (2013.01); *A47L 17/00* (2013.01); *A46B 13/08* (2013.01); *A46B 2200/3006* (2013.01); *A46B 2200/3013* (2013.01); *B08B 1/04* (2013.01)

(58) Field of Classification Search

CPC ..... A46B 13/08; A47L 17/00; A47L 15/0068; A47L 15/0065; A47L 15/37; A47L 15/39; B08B 9/08; B08B 9/0804; B08B 9/0808; B08B 9/087

See application file for complete search history.

(56) References Cited

U.S. PATENT DOCUMENTS

| | | | |
|---|---|---|---|
| 1,921,509 | A | 8/1933 | De Forest |
| 2,398,231 | A | 4/1946 | Kott |
| 2,571,902 | A | 10/1951 | Lever |
| 2,636,393 | A | 4/1953 | Josephs |
| 2,866,215 | A | 12/1958 | Scully |
| 4,799,280 | A | 1/1989 | Lee |
| 5,181,668 | A | 1/1993 | Tsuji et al. |

(Continued)

OTHER PUBLICATIONS

Nicholas Giordano, "College Physics: Reasoning and Relationships," at 352-53 (Brooks/Cole 2010). (Year: 2010).

*Primary Examiner* — Shay Karls

(57) ABSTRACT

Rotary devices and methods of use thereof are disclosed. The rotary devices may be configured as cleaning apparatuses. A cleaning apparatus may include an elongated tube member with an attachment end portion, a holding end portion, an internal cavity, and a helical slot. The cleaning apparatus may also include a handle with a following pin, the tube member extending through the handle with the following pin extending through helical slot. The cleaning apparatus may further include a guide element, a stop member, a first resilient biasing element of a first stiffness and a second resilient biasing element of a second stiffness positioned within the internal cavity. Longitudinal translation of the handle along the tube member from the holding end portion to the attachment end portion rotates the tube member about the longitudinal axis and resiliently deforms the first and second resiliently deforms the biasing elements.

20 Claims, 13 Drawing Sheets

(56) References Cited

U.S. PATENT DOCUMENTS

| | | | | |
|---|---|---|---|---|
| D334,287 | S | 3/1993 | Ingles | |
| 5,488,747 | A | 2/1996 | Woodhouse | |
| 5,491,863 | A | 2/1996 | Dunn | |
| 5,621,941 | A | 4/1997 | Liu | |
| 8,925,138 | B2 | 1/2015 | Kluge, Jr. et al. | |
| 9,265,334 | B1 | 2/2016 | Fung-A-Wing | |
| 2004/0177864 | A1 | 9/2004 | Segalla | |
| 2009/0314738 | A1 | 12/2009 | Siacunco et al. | |
| 2021/0386188 | A1* | 12/2021 | Gillespie ..... | A46B 5/0095 |

* cited by examiner

ROTARY DEVICES AND RELATED METHODS

CROSS REFERENCE TO RELATED APPLICATION

This application is a continuation-in-part of U.S. Non-provisional patent application Ser. No. 16/046,568, filed on Jul. 26, 2018, which claims priority to U.S. Provisional Patent Appl. No. 62/537,081, filed on Jul. 26, 2017, which are hereby incorporated herein by reference in their entireties.

FIELD OF DISCLOSURE

The present invention generally relates to a handheld apparatus for cleaning bottles, drinking glasses and similar containers, and more particularly to handheld container cleaning apparatus that provide rotary motion of a scrubber within the container.

BACKGROUND

Efficient cleaning within a container having an opening leading to a relatively deep containment volume can be difficult. If the opening is of a size that prevents one's hand from reaching within the containment volume, manual movement of a sponge or brush on an end of a relatively long handle is the standard cleaning mode. Although back and forth movement along the length of the cleaning implement is fairly easy, rotational movement of the device, and therefore the sponge or brush, is difficult because of the limited rotational movement of the user's hands/arms. Because of this, it is especially difficult to clean the bottom area of a container where the sides thereof meet a base or bottom portion.

The present disclosure provides a rotary device that in one embodiment provides enhanced rotational movement of a scrubber portion using simple linear movement of a user's hand(s).

Other applications that utilize or require rotational or linear motion can be improved via rotary devices that provide enhanced rotational and linear movement using simple linear movement of a user's hand(s). The present disclosure thereby provides additional rotary devices provide enhanced rotational and linear movement using simple linear movement of a user's hand(s).

In this specification, where a document, act or item of knowledge is referred to or discussed, this reference or discussion is not an admission that the document, act or item of knowledge or any combination thereof was, at the priority date, publicly available, known to the public, part of common general knowledge, or otherwise constitutes prior art under the applicable statutory provisions; or is known to be relevant to an attempt to solve any problem with which this specification is concerned.

SUMMARY

Briefly, the present inventions satisfy the need for improved container cleaning apparatus. The present inventions may address one or more of the problems and deficiencies of the art discussed above. However, it is contemplated that the inventions may prove useful in addressing other problems and deficiencies in a number of technical areas. Therefore, the claimed inventions should not necessarily be construed as limited to addressing any of the particular problems or deficiencies discussed herein.

Certain embodiments of the presently-disclosed insulation and/or fill materials, articles comprising the materials, and methods for forming the materials have several features, no single one of which is solely responsible for their desirable attributes. Without limiting the scope of the insulation and/or fill materials, articles and methods as defined by the claims that follow, their more prominent features will now be discussed briefly. After considering this discussion, and particularly after reading the section of this specification entitled "Detailed Description," one will understand how the features of the various embodiments disclosed herein provide a number of advantages over the current state of the art.

In one aspect, the present disclosure is directed to an apparatus for cleaning a container. The apparatus comprises a tube having a wall that defines an interior, an exterior, an attachment end and a holding end. The tube has a helical slot passing from the exterior to the interior along a portion of the length of the tube. A following pin moves along the helical slot. The following pin extends from the exterior to the interior. The following pin has an external end engaged with a handle and an internal end extending to the tube interior. A biasing element is contained within the tube interior. The biasing element extends from said attachment end to the following pin. A bias engagement element is mounted to the internal end of the following pin and engages the biasing element. A scrubbing element is integrated with the attachment end of the tube. When the handle is pressed towards the attachment end, the tube rotates to turn the scrubber element.

In another aspect, the present disclosure provides a container cleaning apparatus comprising an elongated tube member defining a longitudinal axis and a longitudinal length and comprising an internal cavity, an exterior surface, an attachment end portion at a first end of the longitudinal length, a holding end portion at a second end of the longitudinal length, and a helical slot passing from the exterior surface to the internal cavity extending along at least a portion of the longitudinal length and about the longitudinal axis. The apparatus further comprises a handle, and a following pin extending through said helical slot, said following pin having an internal portion positioned within said internal cavity and an external portion engaged with said handle. The apparatus also comprises a biasing element positioned within said internal cavity and engaged with the internal portion of the following pin and the tube member, and a scrubbing element coupled to said attachment end portion such that said scrubbing element and said tube member are rotationally fixed. Longitudinal translation of the handle along the tube member from the handle end portion to the attachment portion rotates the tube member and the scrubbing element about the longitudinal axis in a first rotational direction and biases the biasing element into a first preloaded state.

In some embodiments, the biasing element is a spring. In some embodiments, the biasing element compromises at least two distinct biasing members, and the apparatus further comprises a guide element positioned at least partially between the at least two distinct biasing members. In some such embodiments, the guide element is a guide ball, and the internal cavity is cylindrical.

In some embodiments, the internal portion of the following pin comprises a spherical outer surface. In some embodiments, the scrubbing element comprises a scrubbing portion and a connector, the connector configured to removably couple with the attachment end portion of the tube member.

In some embodiments, the scrubbing element comprises a scrubbing portion comprising one of a sponge brush, a rocket brush and a wobbler brush. In some embodiments, the handle comprises an aperture extending therethrough, and the tube member extends into the aperture of the handle.

In some embodiments, user application of a first longitudinal force to the handle acting toward the attachment end portion, and user prevention of rotation of the handle about the longitudinal axis, effectuates the longitudinal translation of the handle along the tube member from the handle end portion to the attachment portion. In some such embodiments, in the first preloaded state, the biasing element applies a second longitudinal force to the handle acting toward the handle end portion. In some such embodiments, when the first longitudinal force is not applied to the handle and the handle is prevented from rotating about the longitudinal axis, the second longitudinal force effectuates longitudinal translation of the handle along the tube member from the attachment end portion to the handle end portion and reduction of at least some of the preload of the biasing element.

In some embodiments, the attachment end portion is void of the helical slot, and the attachment end portion includes at least one aperture that extends from the outer surface to the internal cavity. In some such embodiments, the apparatus further comprises at least one guide element positioned within the internal cavity, and the at least one guide element substantially blocks off the internal cavity. In some such embodiments, longitudinal translation of the handle along the tube member from the handle end portion to the attachment end portion translates the at least one guide element into and along the internal cavity in the attachment end portion of the tube member from in the internal cavity of the handle end portion of the tube member or a medial portion of the of the tube member extending between the handle end portion and the attachment end portion. In some such embodiments, longitudinal translation of the handle along the tube member from the attachment end portion to the handle end portion translates the at least one guide element along the internal cavity in the attachment end portion of the tube member and into at least the medial portion of the of the tube member. In some such embodiments, the biasing element compromises at least a first biasing member and a second member, and the at least one guide element is positioned at least partially longitudinally between the first and second biasing members.

In another aspect, the present disclosure provides a method of cleaning a container. The method comprises inserting an apparatus disclosed herein into the container such that the scrubbing element thereof is positioned against a bottom portion of the container and the handle thereof is positioned at the holding end portion. The method further comprises manually applying a first longitudinal force to the handle acting toward the attachment end portion of the apparatus, while preventing rotation of the handle about the longitudinal axis of the apparatus, to longitudinally translate the handle along the tube member of the apparatus from the handle end portion of the apparatus to the attachment portion to rotate the tube member and the scrubbing element about the longitudinal axis in a first rotational direction and preload a biasing element of the apparatus into a first preloaded state such that the biasing element applies a second longitudinal force to the handle acting toward the handle end portion. The method also comprises, while preventing rotation of the handle about the longitudinal axis, allowing the second longitudinal force to longitudinally translate the handle along the tube member from the attachment end portion to the handle portion to rotate the tube member and the scrubbing element about the longitudinal axis in a second rotational direction that opposes the first rotational direction and release at least a portion of the preload of the first preloaded state of the biasing element.

In some embodiments, the attachment end portion of the apparatus is void of the helical slot and includes at least one aperture that extends from the outer surface to the internal cavity, the apparatus further comprises at least one sealing element positioned within the internal cavity that substantially blocks off the internal cavity, the manually applying the first longitudinal force to the handle longitudinally translates the at least one sealing member in the internal cavity of the attachment end portion toward the at least one aperture to force fluid positioned therein therefrom via the at least one aperture, and the allowing the second longitudinal force to longitudinally translate the handle longitudinally translates the at least one sealing member in the internal cavity of the attachment end portion away from the at least one aperture to draw fluid within the container therein via the at least one aperture.

In another aspect, the present disclosure provides a container cleaning apparatus comprising an elongated tube member defining a longitudinal axis and a longitudinal length and comprising an internal cavity, an exterior surface, an attachment end portion at a first end of the longitudinal length, a holding end portion at a second end of the longitudinal length, and a helical slot passing from the exterior surface to the internal cavity extending along at least a portion of the longitudinal length and about the longitudinal axis. The apparatus further comprises a handle, and a following pin extending through said helical slot, said following pin having an internal portion positioned within said internal cavity and an external portion engaged with said handle. The apparatus also comprises a biasing element positioned within said internal cavity and engaged with the internal portion of the following pin and the tube member, and a scrubbing element coupled to said attachment end portion such that said scrubbing element and said tube member are rotationally fixed. In a first configuration, the handle portion is positioned at the handle end portion and the biasing element exerts a first longitudinal force to the internal portion of the handle member that acts in a direction from the attachment end portion toward the handle end portion. In a second configuration, the handle portion is positioned at the attachment end portion and the biasing element exerts a second longitudinal force to the internal portion of the handle member that acts in a direction from the attachment end portion toward the handle end portion, the second longitudinal force being greater than the first longitudinal force. Reconfiguration between the first and second configurations rotates the tube member and the scrubber element about the longitudinal axis and alters a preload of the biasing element.

In some embodiments, the apparatus further comprises at least one guide element positioned within the internal cavity and engaged with the biasing element, the attachment end portion is void of the helical slot, the attachment end portion includes at least one aperture that extends from the exterior surface to the internal cavity, and, in the second configuration, the at least one guide element is positioned in and seals off the internal cavity in the attachment end portion but for the at least one aperture.

In another aspect, the present disclosure provides a rotary cleaning apparatus. The apparatus comprises an elongated tube member defining a longitudinal axis and a longitudinal length, an attachment end portion at a first end of the longitudinal length, a holding end portion at a second end of the longitudinal length, an internal cavity extending from the first end to the second end and through the attachment end portion and the holding end portion, and a helical slot passing from the exterior surface to the internal cavity extending along at least a portion of the longitudinal length and about the longitudinal axis. The apparatus further comprises a handle comprising a through hole and a following pin portion, the tube member extending within the through hole and the following pin portion extending through the helical slot and into the internal cavity. The apparatus also comprises at least one guide element positioned within the internal cavity and configured to translate therein longitudinally. The apparatus further comprises a stop member positioned within the internal cavity in the attachment end portion. The apparatus also comprises a first resilient biasing element positioned within said internal cavity between the following pin portion and the at least one guide element, and a second resilient biasing element positioned within said internal cavity between the at least one guide element and the stop member. Longitudinal translation of the handle along the tube member from the holding end portion to the attachment end portion rotates the tube member about the longitudinal axis in a first rotational direction and resiliently deforms the first and second resilient biasing elements into preloaded states. The first and second resilient biasing elements comprise differing stiffnesses.

In some embodiments, the apparatus further comprises a scrubbing element coupled to said attachment end portion such that said scrubbing element and said tube member are rotationally fixed. In some embodiments, the scrubbing element includes a through hole that extends therethrough and is in communication with the internal cavity, the through hole being configured to allow fluid and/or air to flow through.

In some embodiments, the first resilient biasing element comprises a first spring with a first spring constant, and the second resilient biasing element comprises a second spring with a second spring constant that differs from the first spring constant.

In some embodiments, the apparatus further comprises an engagement member positioned within the internal cavity, the engagement member engaged with the following pin portion and the first resilient biasing element. In some embodiments, the engagement member is spherical and the internal cavity is cylindrical. In some embodiments, the engagement member comprises a maximum width that is at least 70% of a minimum width of a least a portion of the internal cavity. In some embodiments, the first resilient biasing element directly engages the engagement member and the at least one guide element.

In some embodiments, the at least one guide element comprises a first spherical member and the internal cavity is cylindrical. In some embodiments, the at least one guide element comprises a maximum width that is at least 70% of a minimum width of a least a portion of the internal cavity. In some embodiments, the second resilient biasing element directly engages the at least one guide element and the stop member.

In some embodiments, the apparatus further comprises a flexible sheath coupled to the handle and the attachment end portion member that extends about an exterior of the tube member.

In some embodiments, the handle comprises a manually engageable handle portion and a base portion that defines a first portion of the through hole. In some embodiments, the handle portion defines a second portion of the through hole, and the handle portion is pivotably coupled to the base portion. In some embodiments, the handle portion defines a secondary through hole that is substantially coaxial with the first portion of the through hole of the base portion when the handle portion is orientation in a first angled arrangement with respect to the base portion, and the second portion of the through hole is substantially coaxial with the first portion of the through hole when the handle portion is orientation in a first linear arrangement with respect to the base portion.

In some embodiments, the stop member is configured to allow fluid and/or air to flow past the stop member. In some embodiments, the attachment end portion is void of the helical slot and includes at least one open aperture that extends between an inner surface of the tube member that defines the internal cavity and an exterior surface of the tube member that forms at least one unobstructed passageway extending between the internal cavity and the exterior surface. In some embodiments, the at least one open aperture is positioned between the stop member and an end of the attachment end portion.

In some embodiments, user application of a first longitudinal force to the handle acting toward the attachment end portion, and user prevention of rotation of the handle about the longitudinal axis, effectuates the longitudinal translation of the handle along the tube member from the holding end portion to the attachment end portion, translation of the at least one guide element along the internal cavity and into the attachment end portion of the tube member, and deformation of the first resilient biasing element and the second resilient biasing element into a first preloaded state, and, in the first preloaded state, the first resilient biasing element and the second resilient biasing element apply a second longitudinal force to the handle acting toward the holding end portion. In some embodiments, when the first longitudinal force is not applied to the handle and the handle is prevented from rotating about the longitudinal axis, the second longitudinal force effectuates longitudinal translation of the handle along the tube member from the attachment end portion to the holding end portion.

These and other features and advantages of this invention will become apparent from the following detailed description of the various aspects of the invention taken in conjunction with the appended claims and the accompanying drawings.

BRIEF DESCRIPTION OF DRAWINGS

For the purposes of illustrating the invention, the drawings show aspects of one or more embodiments of the invention. However, it should be understood that the present invention is not limited to the precise arrangements and instrumentalities shown in the drawings, wherein.

DETAILED DESCRIPTION

Figure 1:
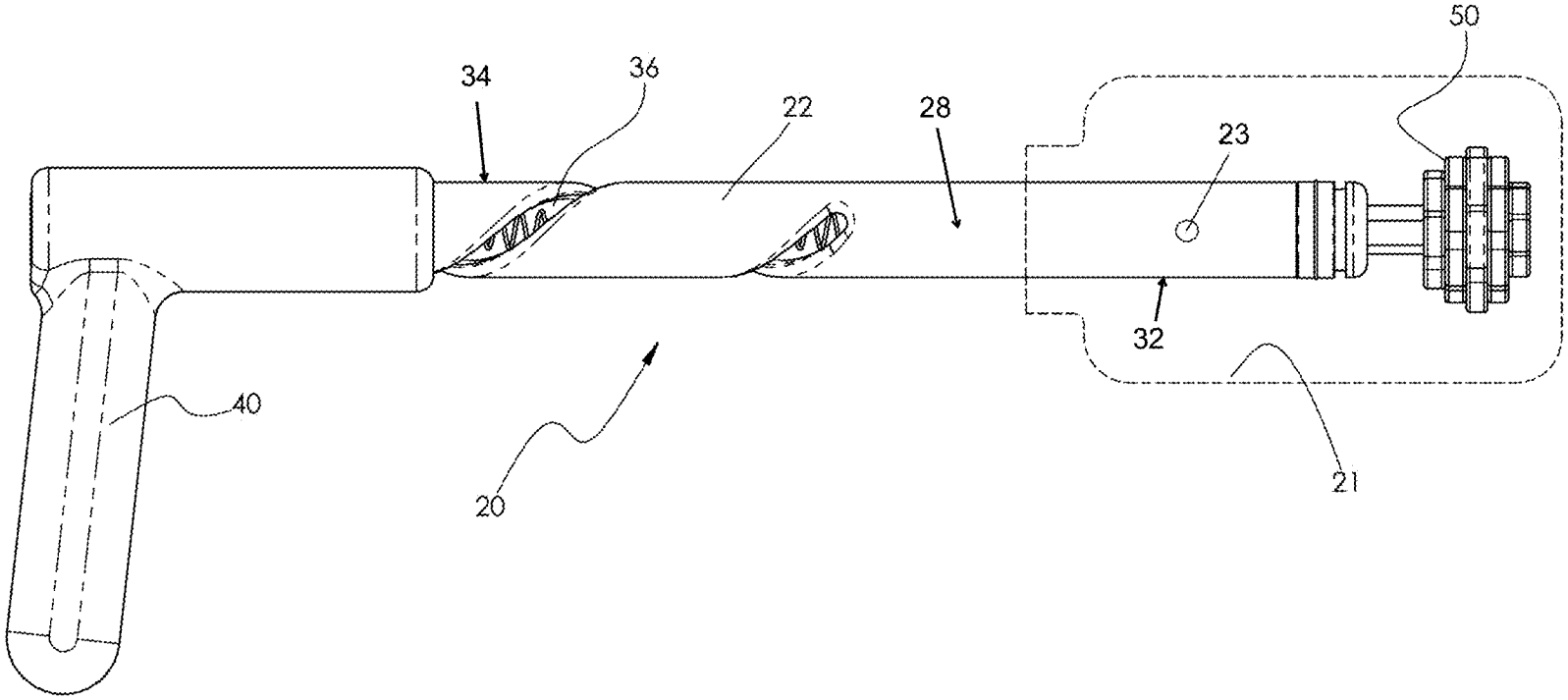
FIG. 1 is a side view of a rotary device configured as an exemplary container cleaning apparatus according to the present disclosure.
Figure 2:
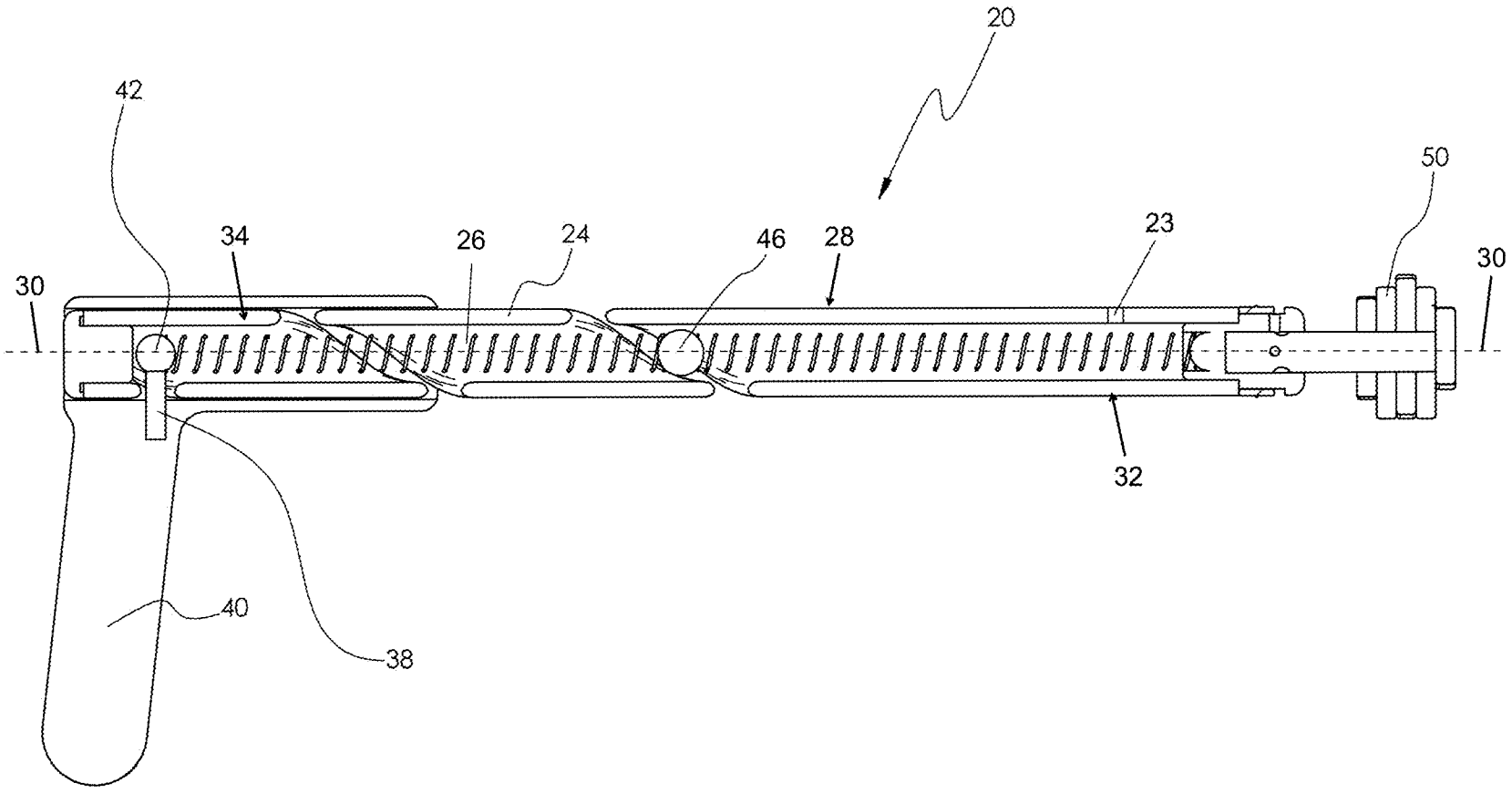
FIG. 2 is a side cross-sectional view of the apparatus shown in FIG. 1.
Figure 3:
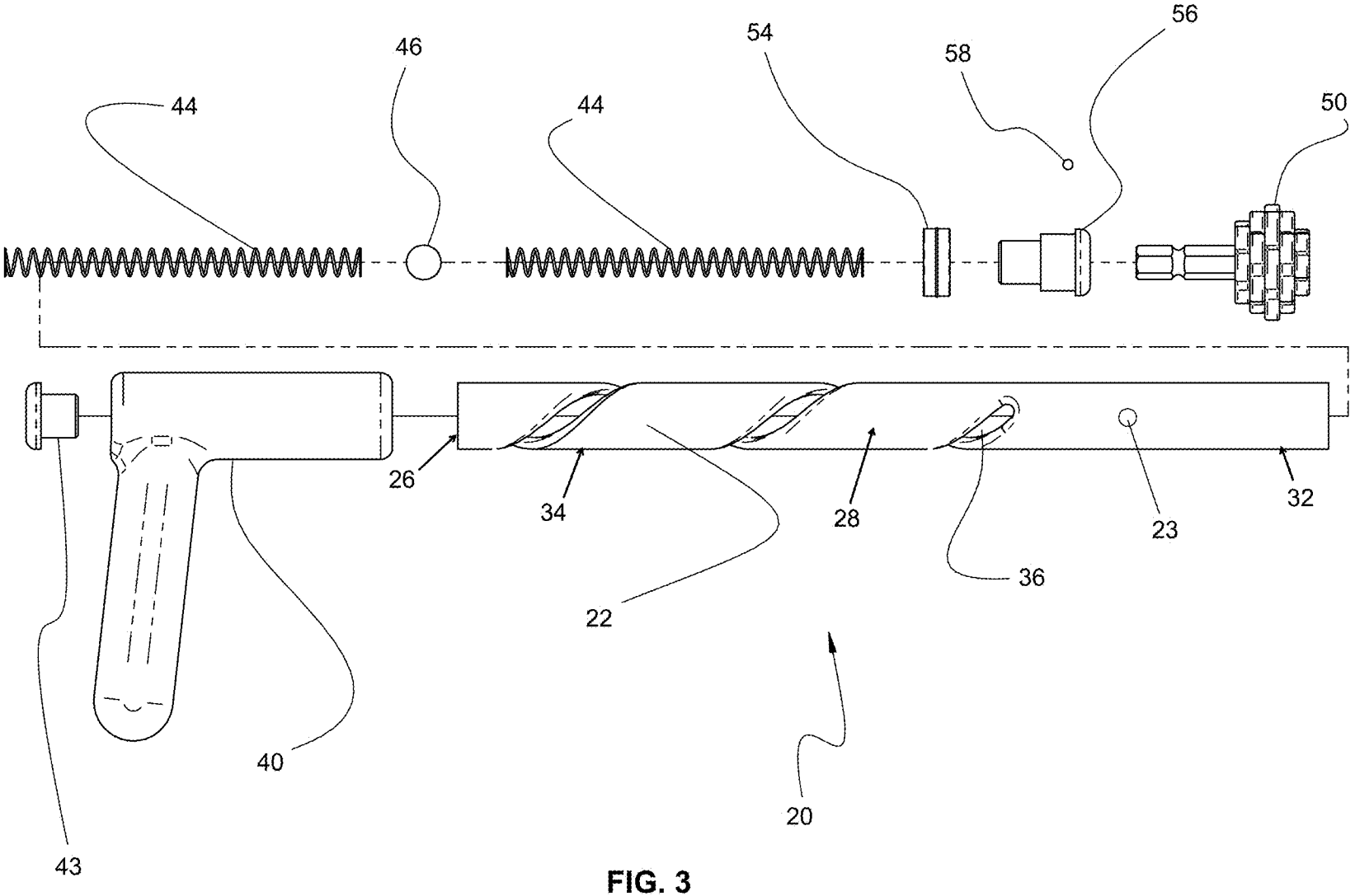
FIG. 3 is an exploded view of the apparatus shown in FIG. 1 illustrating various elements of the apparatus.

Aspects of the present invention and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the invention in detail. It should be understood, however, that the detailed description and the specific example(s), while indicating embodiments of the invention, are given by way of illustration only, and are not by way of limitation. Various substitutions, modifications, additions and/or arrangements within the spirit and/or scope of the underlying inventive concepts will be apparent to those skilled in the art from this disclosure.

An exemplary apparatus, rotary scrubber or container cleaning apparatus 20 according to the present disclosure is illustrated in FIGS. 1-7C. Apparatus 20 may be configured to be used as an apparatus for cleaning containers 21, especially containers 21 having openings that lead to relatively deep containment volumes where it is difficult to clean the sides and/or base of the container.

As shown in FIGS. 1-6B, apparatus 20 comprises a longitudinally-extended elongate tube member 22 having a wall 24 that defines an internal tube cavity or interior 26, a tube exterior surface 28, a longitudinal tube length, a longitudinal tube axis 30, an attachment end portion 32 and a holding end portion 34. Tube member 22 includes a helical slot 36 that passes from the exterior surface 28 to the internal cavity 26. Helical slot 36 runs along a portion of the length of the tube 22, primarily along the holding end portion 34 and a medial portion extending between the holding end portion 34 and the attachment end portion 32. The attachment end portion 32 may thereby be void of the helical slot 36. As explained further below, as shown in FIGS. 1-6B the attachment end portion 32 may be sealed, solid or consistent but for at least one aperture 23 that allows for the intake or suction of fluid into the internal cavity 26 of the attachment end portion 32 from the container 21, and the ejection or forcing out of fluid within the internal cavity 26 of the attachment end portion 32 into the container 21. In this way, the attachment end portion 32 of the apparatus 20 may function as a fluid pump that intakes fluid from the container 21 and sprays one or more jets or streams of fluid into the container 21 to help clean the container 21 during operation of the apparatus, as explained further below. In some embodiments, the at least one aperture 23 extends through the side wall the attachment end portion 32 of the tube member 22 proximate to the scrubber element 50, as shown in FIGS. 1-6B.

While the at least one aperture 23 is depicted in FIGS. 1-6B as extends through the tube member 22 side wall at the attachment end portion 32 (proximate to the scrubber element 50), the at least one aperture 23 may otherwise extend from the end portion of the internal cavity 26 in the attachment end portion 32 proximate to the scrubber element 50. In some other embodiments, the at least one aperture 23 extends through the longitudinal end of the internal cavity 26 and/or tube member 22. For example, the at least one aperture 23 may extend through a lock collar 54, an attachment end plug 56 and/or a lock element 58 positioned in or at (or that defines) the longitudinal end of the internal cavity 26 of the attachment end portion 32 (and thereby the tube member 22 itself). In some other embodiments, the at least one aperture 23 extends through attachment portion of the scrubber element 50.

As shown in FIGS. 2, 4B, 5B and 6B, the apparatus 20 also includes a following pin 38 positioned within or extends through the helical slot 36. Following pin 38 extends from the exterior 28 of tube 22 to the interior cavity 26 of tube 22. Following pin 38 has an external end portion that engages with a handle 40 and an internal end portion that terminates within the cavity 26 as bias engagement element 42, as shown in FIGS. 2, 4B, 5B and 6B.

Handle 40 is designed for easy ergonomic grasping by the user, as shown in FIGS. 1-6B. Although handle 40 is shown extending off to one side of apparatus 20, it is possible to also have a handle 40 that is more or less symmetric with holding end portion 34. Handle 40 may also be off centered or tilt relative to tube axis 30. Additionally, a holding end plug 43 may be used to secure handle 40 to holding end portion 34 and/or plug tube 22. Handle 40 may include an aperture or tube portion that extends therethrough to allow the tube member 22 to extend and longitudinally translate therethrough and rotate therein, as shown in FIGS. 1-6B. In some embodiments, the handle 40 may include an aperture or front and back portions that allow a user to insert their fingers therein/therebetween so as to manually apply a first longitudinal force to the handle 40 acting in a direction toward the attachment end portion 32 from the holding end portion 34, and a second longitudinal force to the handle 40 acting in a direction toward the holding end portion 34 and the attachment end portion 32. The handle 40 may also allow a user to manually grasp the handle 40 to prevent rotation of the handle 40 about the longitudinal axis of the tube member 22.

As shown in FIGS. 1-6B, the apparatus 20 also includes a biasing element or member 44 that resides within tube interior cavity 26. In one embodiment, the biasing element 44 extends from attachment end 32 to the interior end portion of following pin 38 (i.e., the internal portion of the following pin 38 engages biasing element 44). Biasing element 44 may be a spring or any other elastically deformable material or construct. In some embodiments, the interior end portion of following pin 38 may have a spherical surface to better engage biasing element 44, especially if the biasing element is a coiled spring. Additionally, biasing element 44 may be two or more biasing elements with a guide element 46 between adjacent or neighboring biasing elements, as shown in FIGS. 1-6B. A guide element 46 may help to center the biasing element 44 along tube axis 30 and minimize binding of the biasing element 44 as the biasing element 44 expands and contracts. In some embodiments, guide element 46 may be in the shape of a guide ball, and the internal cavity 26 may be cylindrical. In some embodiments, the biasing element 44 may substantially seal, fill or closes off the internal cavity 26. In some embodiments, the apparatus 20 may include a sealing member that substantially seals, fills or closes off the internal cavity 26, and is translated within the internal cavity 26 with/by longitudinal movement of the handle 40.

Figure 6A:
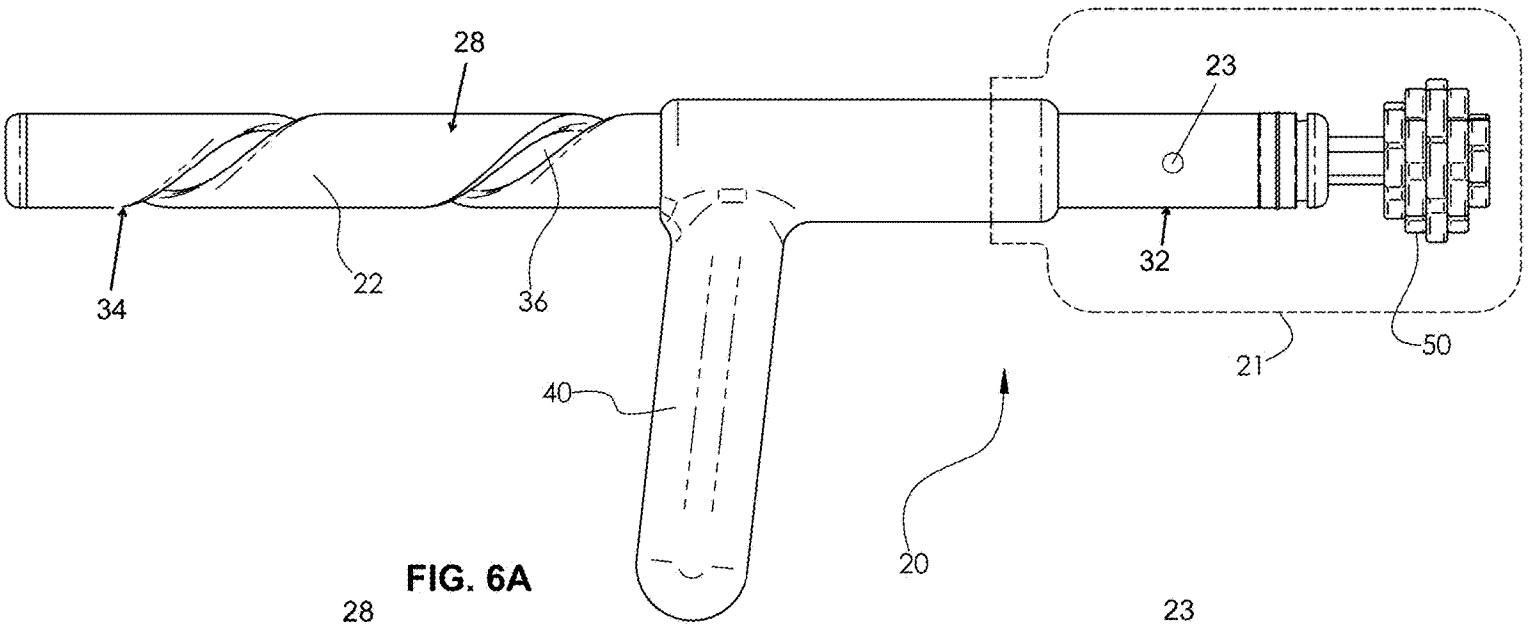
FIG. 6A is a side view of the apparatus shown in FIG. 1 in a third state of use.
Figure 6B:
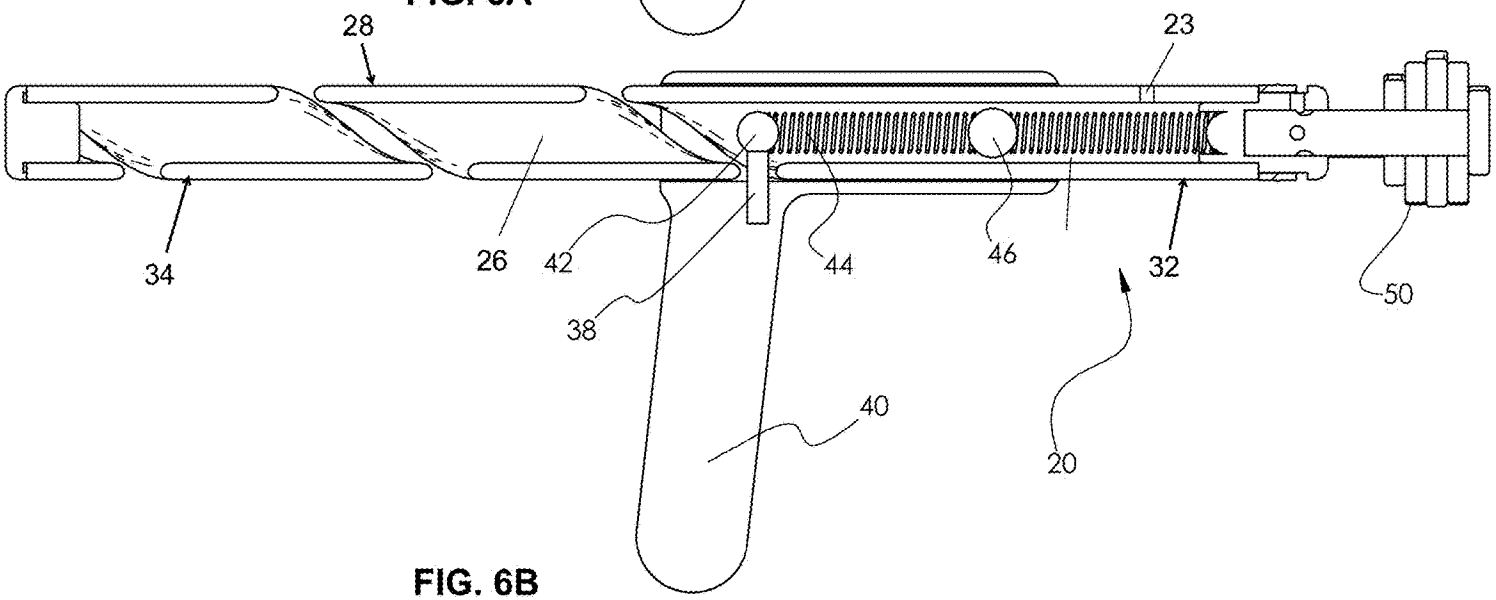
FIG. 6B is a side cross-sectional view of the apparatus shown in FIG. 6A.
Figures 7A, 7B, 7C:
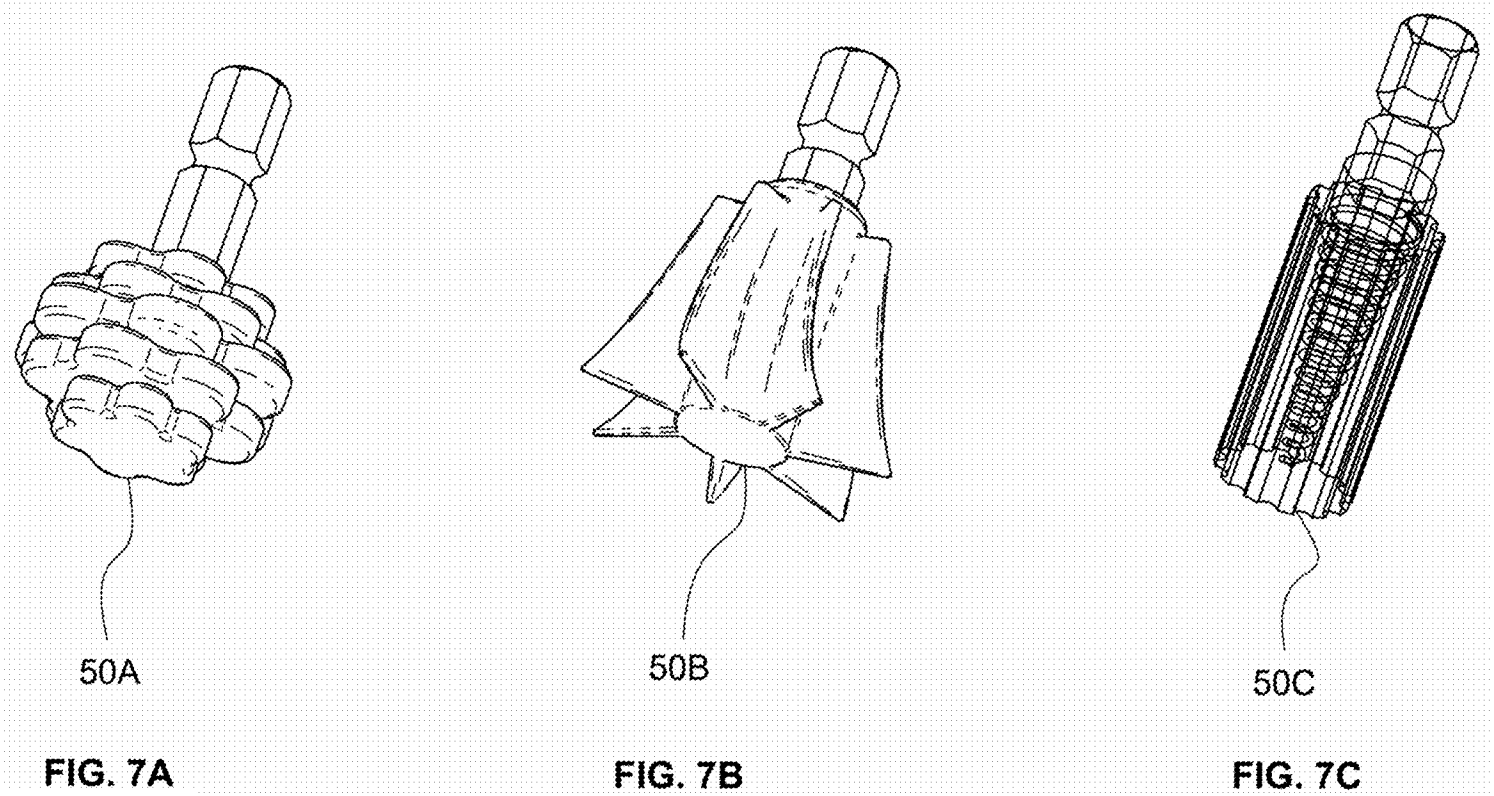
FIG. 7A is a perspective view of one embodiment of a scrubbing element that may be used in conjunction with the apparatus of FIG. 1.
FIG. 7B is a perspective view of one embodiment of another scrubbing element that may be used in conjunction with the apparatus of FIG. 1.
FIG. 7C is a perspective view of one embodiment of another scrubbing element that may be used in conjunction with the apparatus of FIG. 1.

As shown in FIGS. 1-7C, the apparatus 20 may further comprises a scrubbing element 50 integrated or coupled with the attachment end portion 32 of tube member 22. A connector 52 may extend from scrubbing element 50, and may be removably coupled with the attachment end portion 32 to aid in quick release between different types or configurations of scrubbing elements 50. The connector 52 and the attachment end portion 32 of tube member 22 may be configured to removably couple together such that they are rotationally fixed to each other. In some embodiments, connector 52 may include a lock collar 54, an attachment end plug 56 and a lock element 58. FIGS. 7A-7C shows various types of scrubbing elements 50 that may be interfaced with apparatus 20. FIG. 7A is a sponge brush 50*a*, FIG. 7B is a rocket 50*b* and FIG. 7C is a wobbler 50*c*. Each scrubbing element 50*a*-50*c* provides a different cleaning action. Although three types of scrubbing elements 50 are shown (50*a*, 50*b* and 50*c*) it is understood that many more types of scrubbing elements can be attached to apparatus 20.

Figure 4A:
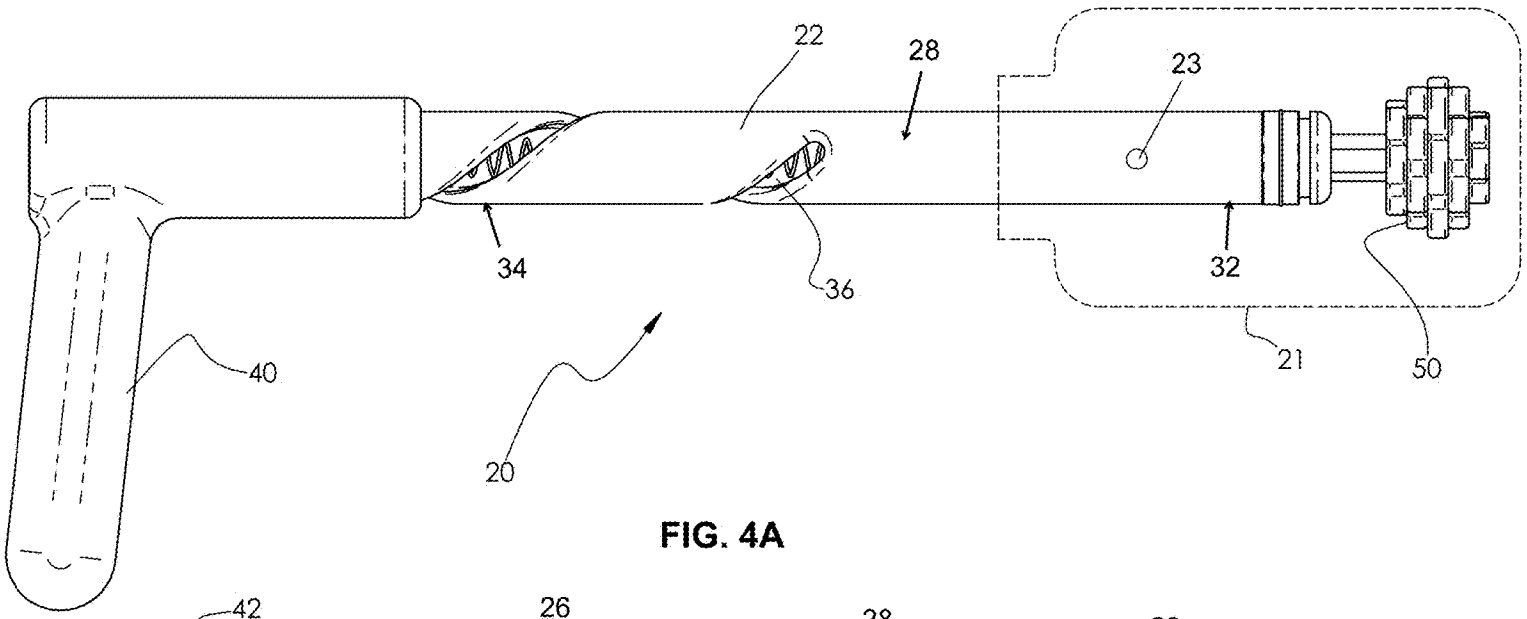
FIG. 4A is a side view of the apparatus shown in FIG. 1 in a first state of use.
Figure 4B:
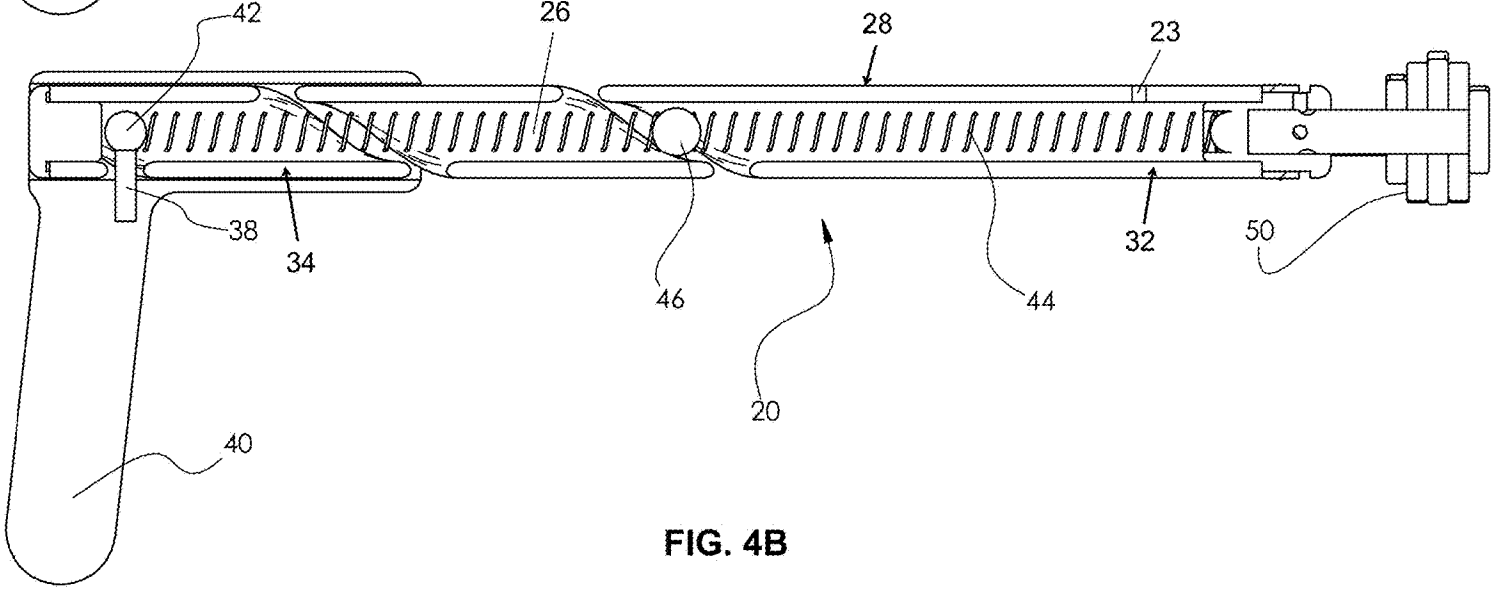
FIG. 4B is a side cross-sectional view of the apparatus shown in FIG. 4A.
Figure 5A:
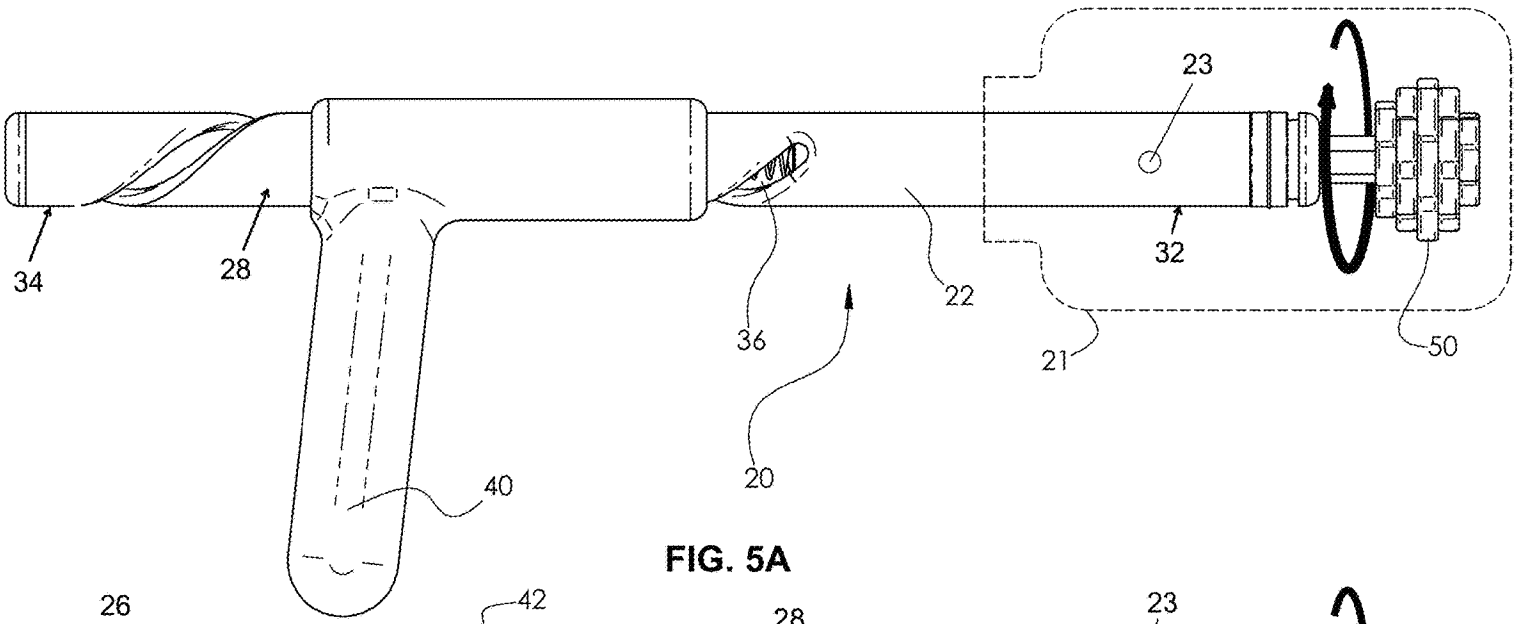
FIG. 5A is a side view of the apparatus shown in FIG. 1 in a second state of use.
Figure 5B:
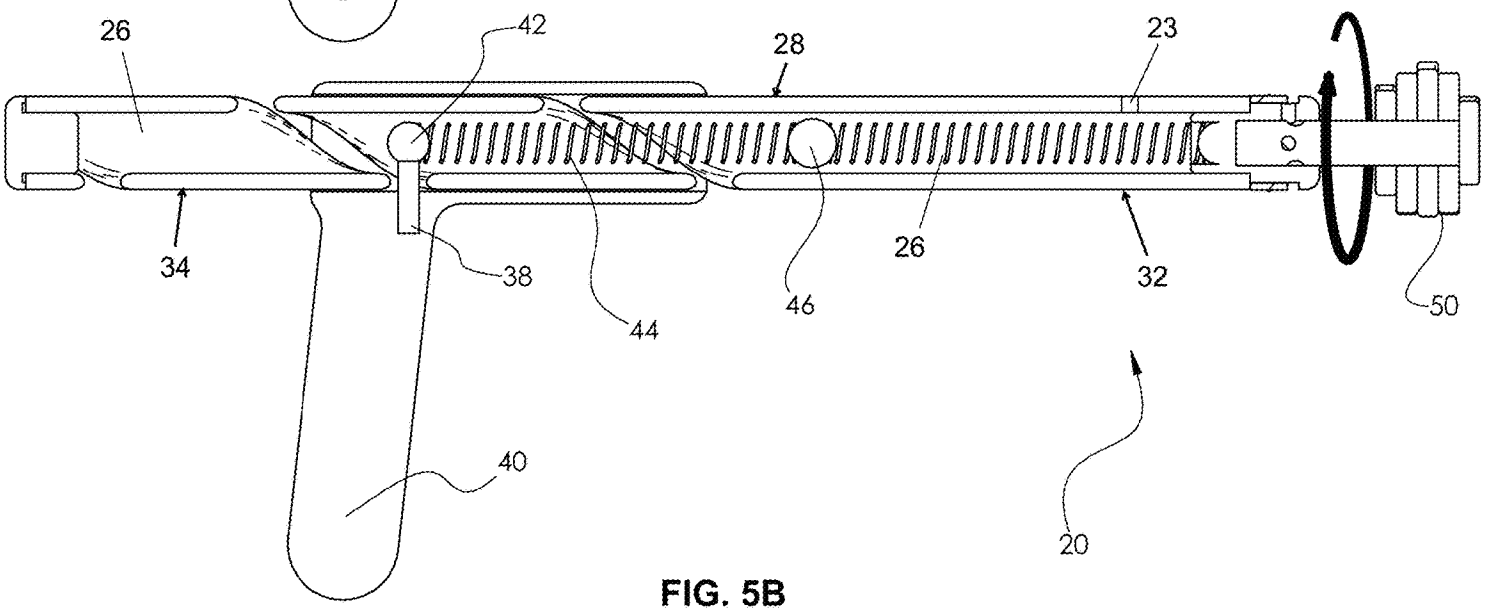
FIG. 5B is a side cross-sectional view of the apparatus shown in FIG. 5A.

Operation of apparatus 20 is shown in FIGS. 4A-6B. FIGS. 4A-4B show a first state of use of apparatus 20. As shown in FIGS. 4A-4B, in the first state the bias element(s) 44 are extended with handle 40 positioned at holding end portion 34. The following pin 38 is within helical slot 36 at or near holding end portion 34. In a second state of use, as shown in FIGS. 5A-5B, handle 40 has been longitudinally forced or pushed towards attachment end portion 32, while being prevented from rotating about the longitudinal axis, with scrubbing element 50 pressing against container 21. The longitudinal force and translation compresses or otherwise preloads biasing element(s) 44, which causes following pin 38 and guide member to travel along helical slot 36. As following pin 38 moves towards attachment end 32 along helical slot 36, and the handle 40 and following pin 38 is prevented form rotating about the tube member 22, the tube member 22 rotates. Rotation of tube member 22 causes scrubbing element 50 to also rotate as the scrubbing element is rotationally fixed to the attachment end portion 32 of the tube 22. This action thereby creates rotation of scrubbing element 50 around tube axis 30 from the linear movement of the user's hand and the handle 40 and following pin 38. Scrubbing element 50 may be further rotated, in third state of use, by pushing handle 40 still further towards attachment end 32 as seen in FIGS. 6A-6B. Upon release of the user's longitudinal force against handle 40, but while the handle 40 is prevented from rotating about the tube member 22, the biasing element(s) 44 expands or otherwise releases the preload and moves the following pin 38 and handle 40 back along helical slot 36 allowing scrubbing element 50 to rotate now in the opposite direction. Therefore, a quick longitudinal push and release action by the user's hand, while preventing the handle 40 and following pin 38 from rotating about the tube member 22, creates back and forth rotation of the scrubbing element 50 within the container 21.

As also shown in FIGS. 4A-6B, in some embodiments the longitudinal travel of the handle 40 and following pin 38 along the tube member 22 may also translate the at least one guide member 46 (and/or another sealing member) into or out of and along the internal cavity 26 of the attachment end portion 32 to form a positive or negative pressure, respectively, therein. For example, longitudinal translation of the handle 40 along the tube member 22 from the holding end portion 34 to the attachment end portion 32 may translate the at least one guide element 46 (and/or another sealing member) into and along the internal cavity 26 in the attachment end portion 32 of the tube member 22 from in the internal cavity 26 of the holding end portion 34 of the tube member 22 or a medial portion of the of the tube member 22 extending between the holding end portion 34 and the attachment end portion 32. When the user manually applies the longitudinal force to the handle 40 to longitudinally translate the at least one guide element 46 (and/or another sealing member) in the internal cavity 26 of the attachment end portion 32 toward the at least one aperture 23, a positive pressure is created, and any force fluid positioned therein is pushed or ejected therefrom via the at least one aperture 23. Such a flow, stream or jet of water may aide in cleaning the container 21. The at least one aperture 23 thereby also prevents pressure buildup and/or blockage of the internal cavity 26 at the attachment end portion 32 from preventing full longitudinal translation of the handle 40 (and the following pin 38 in the helical slot 36), and thereby full stroke or rotation of the scrubber member 50.

Similarly, longitudinal translation of the handle 40 along the tube member 22 from the attachment end portion 32 to the holding end portion 34 may translate the at least one guide element 46 (and/or another sealing member) along the internal cavity 26 in the attachment end portion 32 of the tube member 22 and into at least the medial portion of the of the tube member 22. When the biasing element(s) 44 preloaded force longitudinally translate the handle 40 and the at least one guide element 46 (and/or another sealing member) in the internal cavity 26 of the attachment end portion 32 away from the at least one aperture 23, a negative pressure or suction is created to draw fluid within the container 21 about the attachment end portion 32 therein via the at least one aperture 23. The at least one aperture 23 thereby also prevents suction or sticking of the internal cavity 26 at the attachment end portion 32 from preventing longitudinal translation of the handle 40 (and the following pin 38 in the helical slot 36) away from the attachment end portion 32.

Figure 8A:
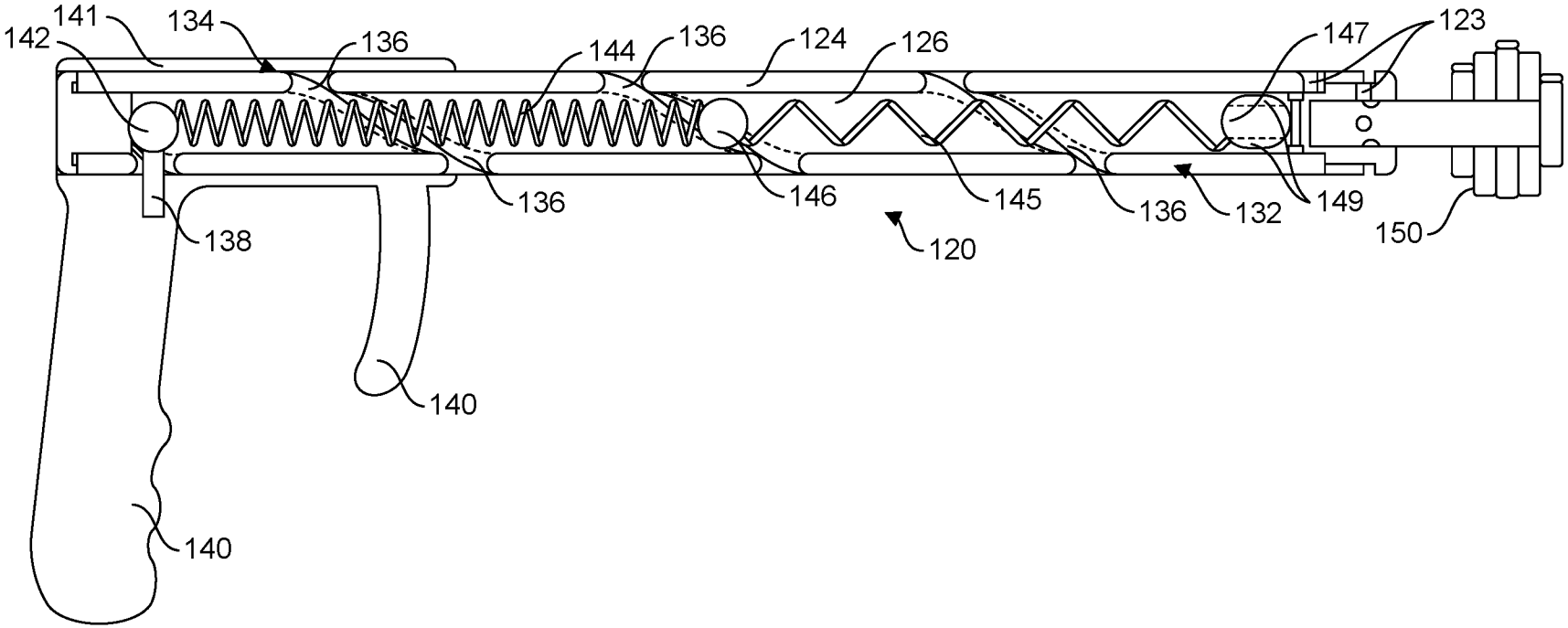
FIG. 8A is a side cross-sectional view of a rotary device configured as another exemplary container cleaning apparatus according to the present disclosure.
Figure 8B:
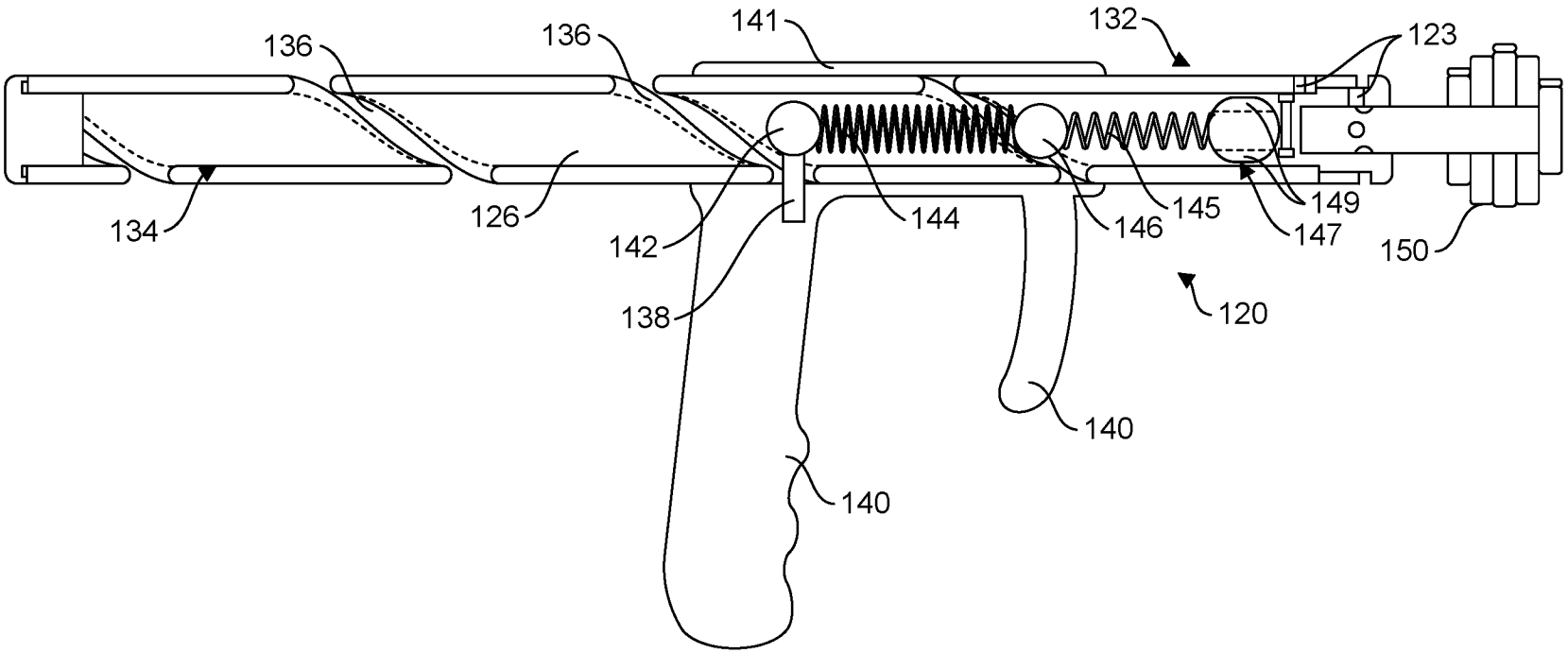
FIG. 8B is a side cross-sectional view of the apparatus shown in FIG. 8A in a first state of use.

Another exemplary embodiment of a rotary device configured as a rotary scrubber or container cleaning apparatus 120 according to the present disclosure is illustrated in FIGS. 8A and 8B. The apparatus 120 of FIGS. 8A and 8B is substantially similar to the apparatus 20 described above with respect to FIGS. 1-7C, and therefore like reference numerals preceded with "1" are used to indicate like components, aspects, functions, processes or functions, and the description above directed to thereto equally applies, and is not repeated for brevity and clarity purposes.

As shown in FIGS. 8A and 8B, apparatus 120 includes at least one first resilient member 144 (e.g., at least one first spring) and a separate and distinct at least one second resilient member 145 (e.g., at least one second spring) within the interior cavity 126 of the tube member 122. In some embodiments, the at least one first resilient member 144 may be positioned proximate to the holding end portion 134 relative to the at least one second resilient member 145, and the at least one second resilient member 145 may be positioned proximate to the attachment end portion 32 relative to the at least one first resilient member 144, as shown in FIGS. 8A and 8B. The at least one first resilient member 144 and the at least one second resilient member 145 may comprise differing stiffnesses/elasticities (e.g., spring constants) such that the one of them requires more force to contract during use, and exerts more force when compressed/preloaded, than the other. For example, in some embodiments, the at least one first resilient member 144 may comprise a lighter compression/stiffness rating than the at least one second resilient member 145. As another example, in some embodiments, the at least one second resilient member 145 may comprise a lighter compression/stiffness rating than the at least one first resilient member 144. The compression/stiffness rating differences between the at least one first resilient member 144 and the at least one second resilient member 145 prevents binding of the members and provides a smooth action of the operation of the apparatus 120 (particularly as compared to a single resilient member, for example), as described above.

As also shown in FIGS. 8A and 8B, the guide element 146 is positioned between the at least one first resilient member 144 and the at least one second resilient member 145. As discussed above, the guide element 146 acts as a piston as it travels through/within the interior cavity 126 of the tube member 122 as the user forces the handle 140 toward the attachment end 132. For example, when the guide element 146 is positioned within the attachment end 132 past the helical slot 36, further translation of the guide element 146 toward the end of the attachment end 132 act to compress and force liquid and/or gas located within the interior cavity 126 out of the at least one aperture 123. The engagement element 142 may similarly act as a piston as it travels through/within the interior cavity 126 of the tube member 122 as the user forces the handle 140 toward the attachment end 132. In some embodiments, the maximum width or diameter of the guide element 146 and/or the engagement element 142 may be at least 50%, at least 60%, at least 70%, at least 80%, at least 90% or at least 95% of the minimum width or diameter of the interior cavity 126. The engagement element 142 may be coupled to the following pin 142 as shown in FIGS. 8A and 8B. In another embodiment, the engagement element 142 may comprise a separate and distinct piece than the following pin 142 and be positioned adjacent to the following pin 142 toward the attachment end portion 132. For example, the engagement element 142 may comprise a spherical member that is positioned between the following pin 142 and the at least one first resilient member 144. It is noted that the least one aperture 123 may extend through the side wall of the tube member 122 and/or through at least a portion of the scrubber member 150 to the environment exterior of the apparatus 120. It is also noted that in some alternative embodiments, the apparatus 120 may include one or more additional separate and distinct resilient members that are separated by one or more corresponding guide elements.

The handle 140 of the apparatus 120 may include a manually engageable grip or handle portion 140 and a base or shaft portion 141, as shown in FIGS. 8A and 8B. The base portion 141 of the handle 140 may form an enclosed tube or cylindrical passageway through which the tube member 122 translates during use, as shown in FIG. 8B. The base portion 141 of the handle 140 may thereby enclose or surround a portion of the exterior surface of the tube member 122, and thereby substantially block or close off the helical slot 136. Thereby, once the base portion 141 of the handle 140 reaches the attachment end portion 132 of the tube member 122 past the helical slot 136 (i.e., is void of the helical slot 136), the portion of the interior cavity 126 past the engagement element 142 may be pressurized via movement of the engagement element 142 toward the scrubber element 150 and/or the portion of the interior cavity 126 past the guide element 146 may be pressurized via movement of the guide element 146 toward the scrubber element 150.

As shown in FIGS. 8A and 8B, the apparatus 120 also includes a lower stopper member 147 in the attachment end portion 132. The lower stopper member 147 may be fixed within the attachment end portion 132, or may be movable along the internal cavity 126 but biased into the attachment end portion 132 via the at least one first resilient member 144 and the at least one second resilient member 145. The stop member is configured to allow fluid and/or air to flow past the stop member 145 to the open aperture 123 in the tube member 122 and/or scrubber element 150 to allow for the flow of air and/or fluid between the internal cavity 126 and the environment exterior of the apparatus 120. For example, as shown in FIGS. 8A and 8B, the stop member 145 may include at least one through hole or aperture that allows fluid and/or air to flow through (and thereby past) the stop member 145. As another example, the stop member 145 may include a slot or other outer surface profile that forms a channel between the interior surface of the tube member 122 and the stop member 145 that allows fluid and/or air to flow therethrough (and thereby past the stop member 145). The engagement member 142 and/or the guide member 146 can thereby act as a piston to compress air and/or fluid within the internal cavity 126 and force the air and/or fluid through the at least one open aperture 123 when the handle 140 is translated from the handle end portion 134 to the attachment end portion 132 (and potentially draw a suction or negative pressure within the internal cavity 126 and the air and/or fluid through the at least one open aperture 123 from exterior to the apparatus 120 when the handle 140 is translated from the attachment end portion 132 to the handle end portion 134).

Figure 9:
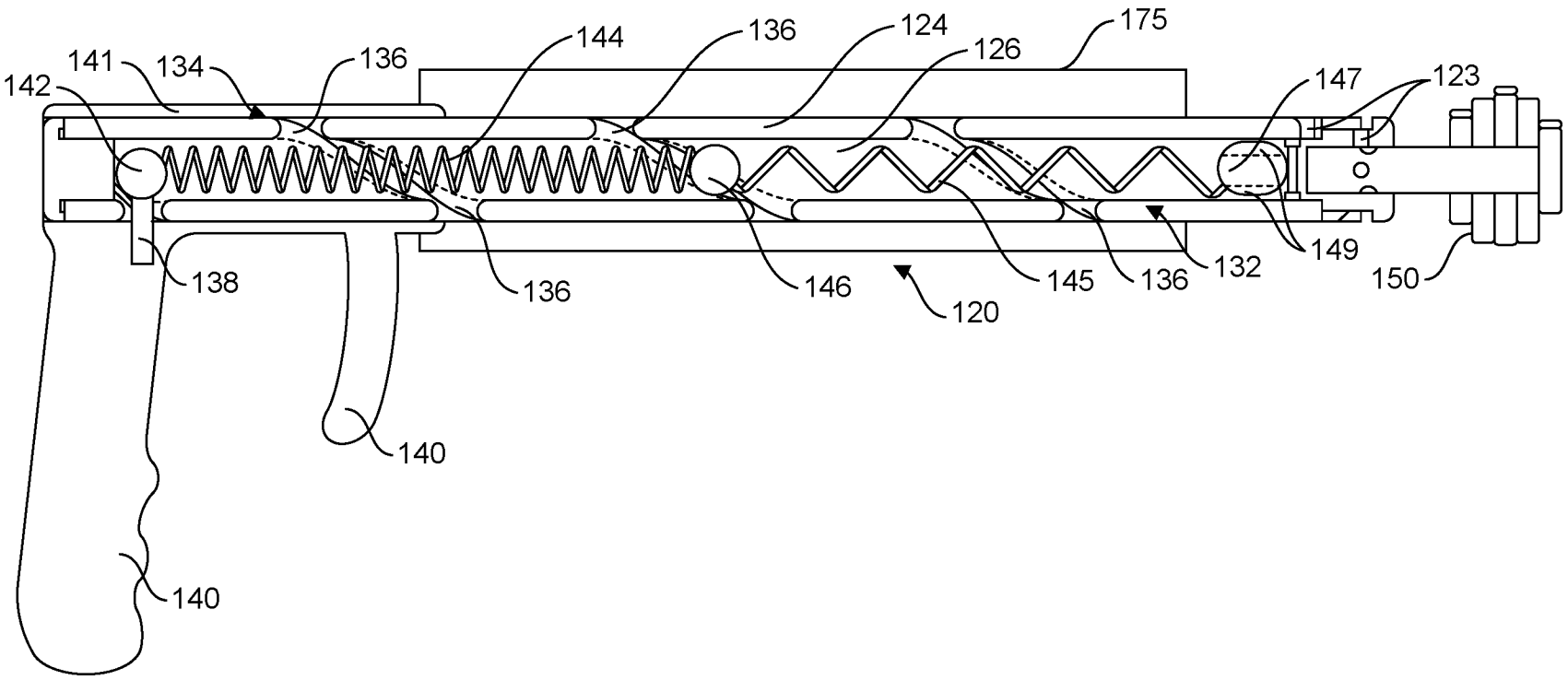
FIG. 9 is a side cross-sectional view of a rotary device configured as another exemplary container cleaning apparatus with a sheath according to the present disclosure.

As shown in FIG. 9, in some embodiments the apparatus 120 may include a flexible protective sheath or covering 175 that is coupled to and extends between the handle portion 140 (such as the base portion 141 thereof) and the attachment end portion 132 of the tube member 122. The flexible sheath 175 extends about an exterior of the tube member 122 so as to encase, enclose or cover the helical slot 136 (or any other lateral openings in the tube member 122) to direct and/or capture fluid and/or air that is forced therethrough during operation of the apparatus 120. For example, the flexible sheath 175 may prevent splashing of water and/or soap from the apparatus 120 to a user during use of the apparatus 120 in a cleaning operation. The flexible sheath 175 is flexible and pliable such that it does not interfere with the translation of the handle 140 a along the tube member 122 and the operation of the apparatus 120, as described above. For example, the flexible sheath 175 may be formed of rubber, silicone, flexible polymer, cloth or any other flexible and compliant material that is effective is preventing fluid and/or air from freely flowing therethrough.

The handle 140 of the apparatus 120 may be configured in a single arrangement or configuration. For example, as shown in FIGS. 8-9, the handle 140 is configure in a single arrangement that facilities user wrapping a hand around the manually engageable portion that extends from the base portion 141 with their palm against a back side of the handle facing toward the handle end portion 134 and their fingers gripping against a front back side of the handle facing toward the attachment end portion 132.

Figure 10A:
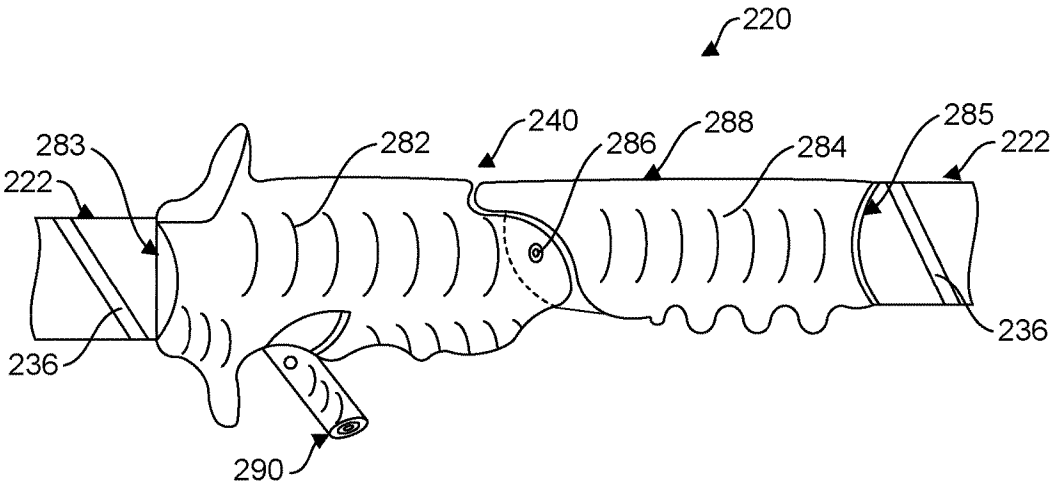
FIG. 10A is side view of a rotary device configured as another exemplary container cleaning apparatus with a configurable handle in a linear arrangement according to the present disclosure.
Figure 10B:
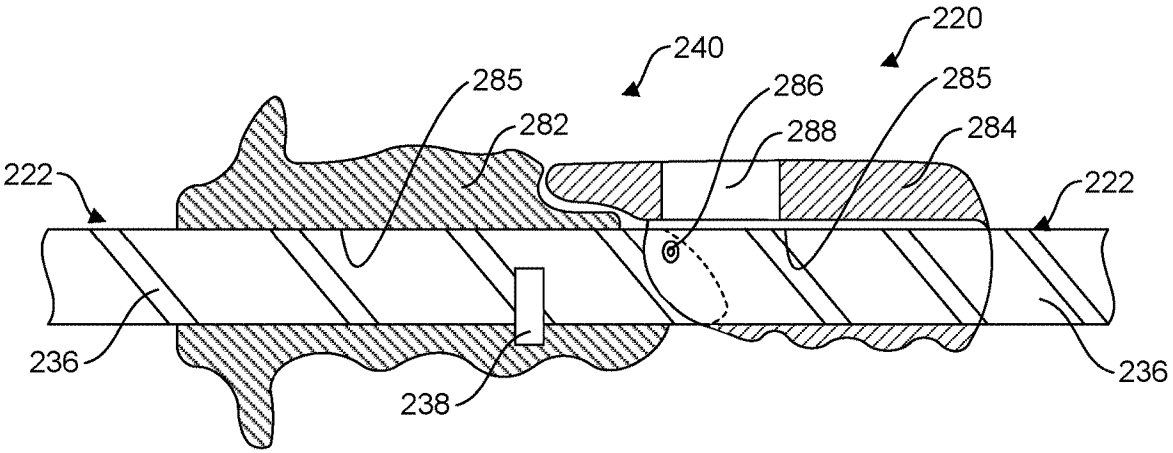
FIG. 10B is side cross-sectional view of the configurable handle of FIG. 10A according to the present disclosure.
Figure 10C:
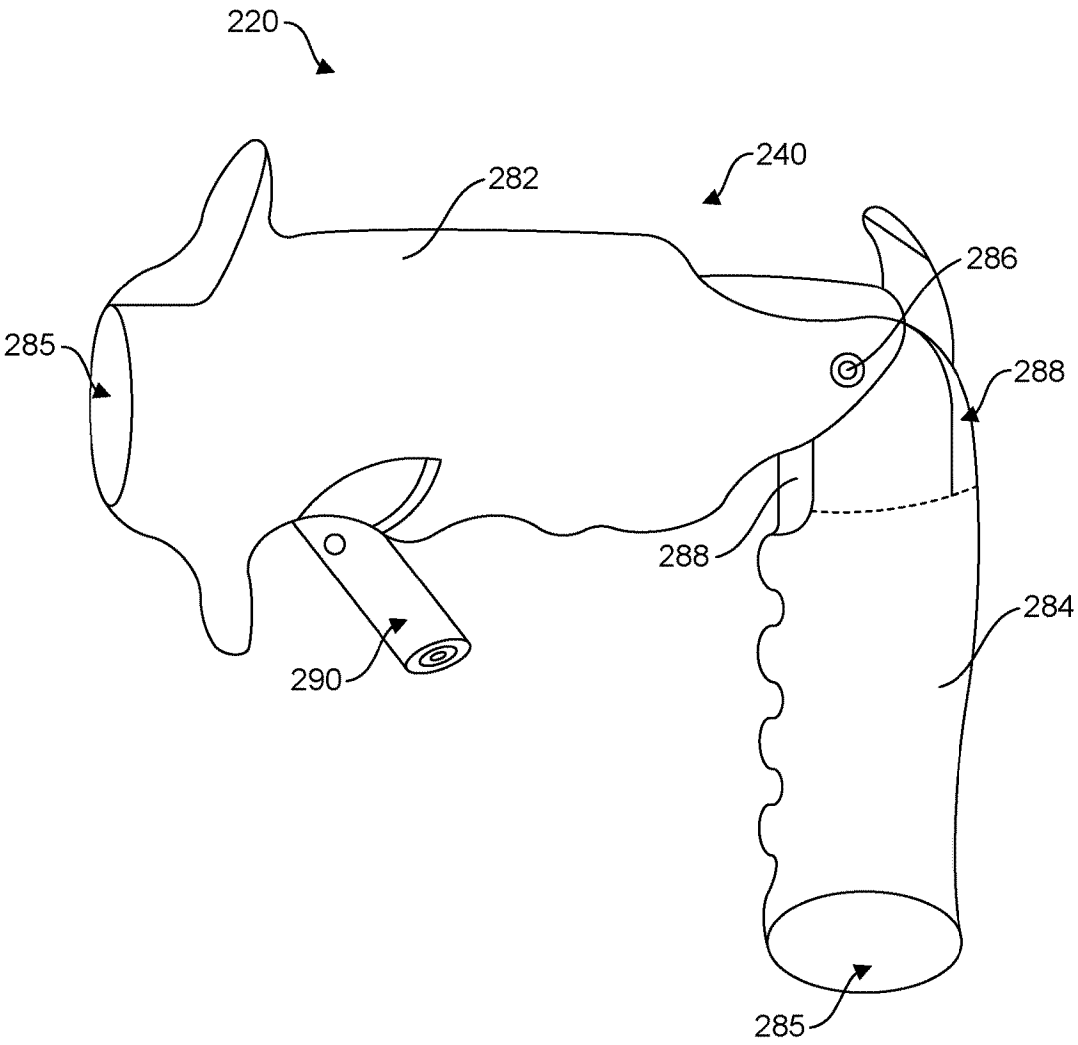
FIG. 10C is side view of the configurable handle of FIG. 10A reconfigured in an angled arrangement according to the present disclosure.

FIGS. 10A-10C illustrate exemplary embodiment of a rotary device configured as a rotary scrubber or container cleaning apparatus 220 with a reconfigurable handle portion 240 according to the present disclosure. The apparatus 220 of FIGS. 10A-10C is substantially similar to the apparatuses 20 and 120 described above, and therefore like reference numerals preceded with "2" are used to indicate like components, aspects, functions, processes or functions, and the description above directed to thereto equally applies, and is not repeated for brevity and clarity purposes.

As shown in FIGS. 10A-10C, the handle portion 240 includes a manually engageable first handle portion 282 that includes a first through hole 283 that is configured such that the tube member 222 is able to extend within and through the first through hole 283. The first handle portion 282 also includes the following pin portion 238 that extends through the helical slot 236 of the tube member 222, as shown in FIG. 10B and described above. In some embodiments, as shown in FIGS. 10A and 10C, the first handle portion 282 may include a lock or cam mechanism 290 configured to selectively engage the tube member 222 and prevent or resist movement of the tube member 222 through the first through hole 283.

As also shown in FIGS. 10A-10C, the handle portion 240 further includes a manually engageable second handle portion 284 that includes a second through hole 285. The second handle portion 284 is pivotably coupled to the first handle portion 282 at a pivot point 286, and selectively manually movable between a substantially coaxial, linear or aligned arrangement as shown FIGS. 10A and 10B, and an angled arrangement (e.g., substantially perpendicular) as shown in FIG. 10C. As shown in FIGS. 10A and 10B, the second handle portion 284 is configured such that when the second through hole 285 is substantially coaxial/aligned with the first through hole 283 of the first handle portion 282 (in the linear arrangement), the tube member 222 is able to translate through the first and second through holes 283, 285. In this way, in the linear arrangement as shown in FIGS. 10A and 10B, the handle portion 240 is arranged as a straight or linear manually engageable handle that can be grasped and used from the lateral side or any number of other ways.

As shown in FIG. 10C, the second handle portion 284 can be pivoted with respect to the first handle portion 282 such that the second through hole 285 is angled with respect to the first through hole 283. In such an arrangement, the handle portion 240 is configured for a pistol grip grasp of a user. In some embodiments, the second handle portion 284 may include a secondary through hole 288 that is configured such that the tube member 222 is able to extend within and through the first through hole 283. The second handle portion 284 may be configured such that in the angled arrangement, as shown in FIG. 10C, the secondary through hole 288 is substantially coaxial/aligned with the first through hole 283 of the first handle portion 282, and thereby the tube member 222 is able to translate through the first through hole 283 and the secondary through hole 288. In this way, in the angled arrangement as shown in FIG. 10C, the handle portion 240 is arranged as an angled handle that can be grasped and used via a pistol grip, for example.

Figure 11:
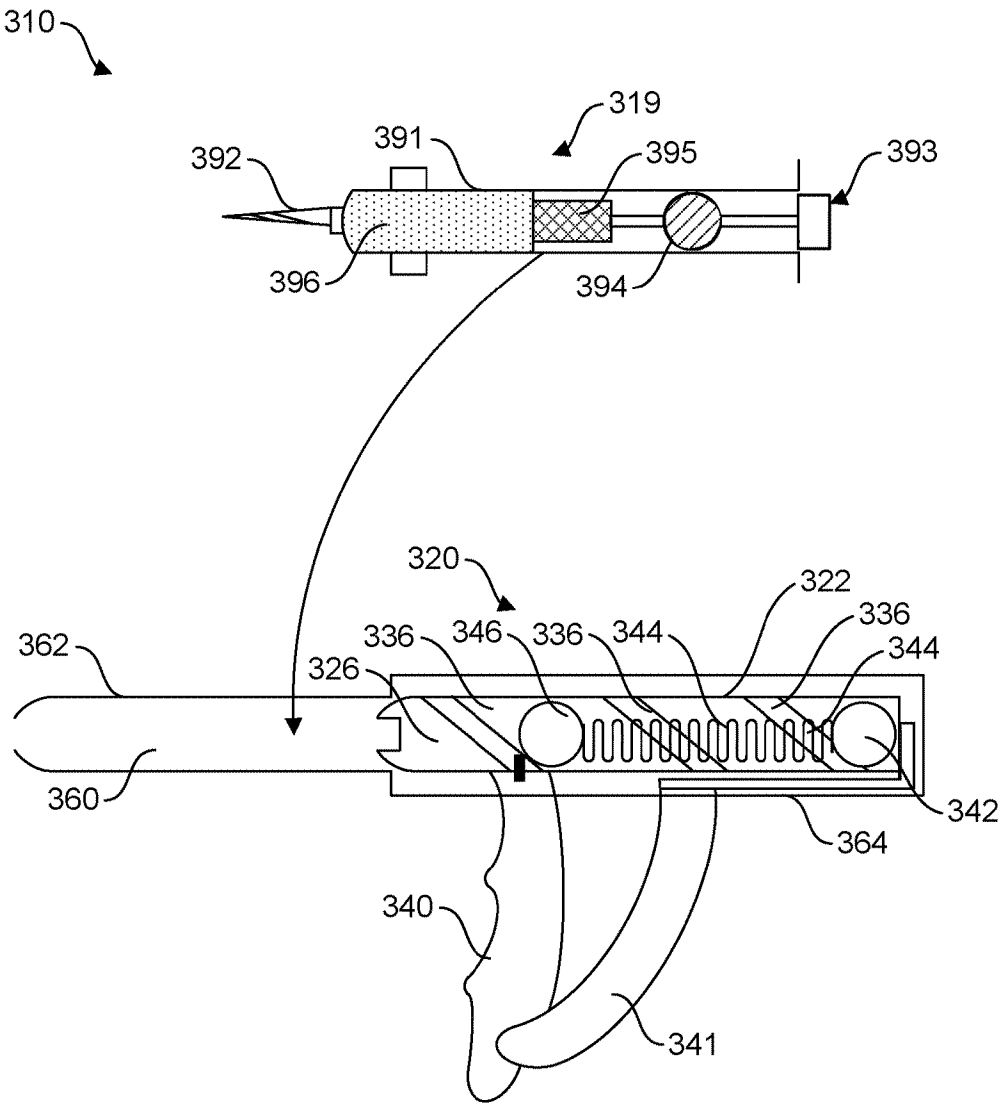
FIG. 11 is a side cross-sectional view of an injection system comprising a manual rotary syringe dispenser and a syringe.

FIG. 11 illustrates exemplary embodiment of a rotary system 310 comprising a rotary injection system comprising a manual rotary syringe dispenser apparatus 320 and a rotary syringe 319. The dispenser apparatus 320 of FIG. 11 is similar to the apparatuses 20, 120 and 220 described above, and therefore like reference numerals preceded with "3" are used to indicate like components, aspects, functions, processes or functions, and the description above directed to thereto equally applies, and is not repeated for brevity and clarity purposes.

As shown in FIG. 11, the rotary syringe 319 include a tubular body portion 391 that defined an internal cavity 396 that may include an injectable substance (e.g., a biologically compatible fluid). The rotary syringe 319 further includes a needle or lumen 293 at one end of the tubular body portion 391 configured to be inserted/injected into a patient or a device for the injection of the substance within the internal cavity 396 into the patient or a device via the needle or lumen 293, as shown in FIG. 11. As also shown in FIG. 11, the rotary syringe 319 also includes a plunger member 393 that extends into the internal cavity 396 from a back end. The plunger member 393 includes a guide member that stabilizes/supports the plunger member 393 within the internal cavity 396, and a plunger 395 that seal off the internal cavity 396. Linear movement of the plunger member 393 within the internal cavity 396 towards the needle or lumen 293 thereby forces the substance within the internal cavity 396 through the needle or lumen 293.

As also shown in FIG. 11, the manual rotary syringe dispenser apparatus 320 comprises a tube member 322 with an internal cavity 326 and a helical slot in a side wall thereof in communication with the internal cavity 326. The manual rotary syringe dispenser apparatus 320 also includes a body member 364 that includes an inner cavity that contains the tube member 322. The body member 364 is configured to allow the tube member 322 to axially/longitudinally translate therein toward an injection holding portion 362. The injection holding portion 362 includes an inner cavity 360 that is configured to contain/hold the rotary syringe 319 therein, as shown in FIG. 11.

As shown in FIG. 11, the first handle portion 341 is engaged with a back end portion of the tube member 322, and can be translated toward a second handle portion (e.g., via manually squeezing the handle portions together) to translate the tube member 322 longitudally within the body member 364 toward the injection holding portion 362. The tube member 322 also includes a first guide member 342, a resiliently compressible member 344 and a second guide member 346 within the internal cavity 326, as shown in FIG. 11. A pin is coupled to the body 354 and positioned within the helical groove 336.

In this way, the first handle 341 can be utilized to translate the tube member 322 toward the syringe 319 within the an inner cavity 360 such that the front end of the tube member 322 engages the back end of the plunger member 393 to dispense the substance.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), "contain" (and any form contain, such as "contains" and "containing"), and any other grammatical variant thereof, are open-ended linking verbs. As a result, a method or article that "comprises", "has", "includes" or "contains" one or more steps or elements possesses those one or more steps or elements, but is not limited to possessing only those one or more steps or elements. Likewise, a step of a method or an element of an article that "comprises", "has", "includes" or "contains" one or more features possesses those one or more features, but is not limited to possessing only those one or more features.

As used herein, the terms "comprising," "has," "including," "containing," and other grammatical variants thereof encompass the terms "consisting of" and "consisting essentially of."

The phrase "consisting essentially of" or grammatical variants thereof when used herein are to be taken as specifying the stated features, integers, steps or components but do not preclude the addition of one or more additional features, integers, steps, components or groups thereof but only if the additional features, integers, steps, components or groups thereof do not materially alter the basic and novel characteristics of the claimed compositions or methods.

All publications cited in this specification are herein incorporated by reference as if each individual publication were specifically and individually indicated to be incorporated by reference herein as though fully set forth.

Subject matter incorporated by reference is not considered to be an alternative to any claim limitations, unless otherwise explicitly indicated.

Where one or more ranges are referred to throughout this specification, each range is intended to be a shorthand format for presenting information, where the range is understood to encompass each discrete point within the range as if the same were fully set forth herein.

While several aspects and embodiments of the present invention have been described and depicted herein, alternative aspects and embodiments may be affected by those skilled in the art to accomplish the same objectives. Accordingly, this disclosure and the appended claims are intended to cover all such further and alternative aspects and embodiments as fall within the true spirit and scope of the invention.

I claim:

1. A rotary cleaning apparatus, comprising:

an elongated tube member defining a longitudinal axis and a longitudinal length, an attachment end portion at a first end of the longitudinal length, a holding end portion at a second end of the longitudinal length, an internal cavity extending from the first end to the second end and through the attachment end portion and the holding end portion, and a helical slot passing from the exterior surface to the internal cavity extending along at least a portion of the longitudinal length and about the longitudinal axis;

a handle comprising a through hole and a following pin portion, the tube member extending within the through hole and the following pin portion extending through the helical slot and into the internal cavity;

at least one guide element positioned within the internal cavity and configured to translate therein longitudinally;

a stop member positioned within the internal cavity in the attachment end portion;

a first resilient biasing element positioned within said internal cavity between the following pin portion and the at least one guide element; and a second resilient biasing element positioned within said internal cavity between the at least one guide element and the stop member, wherein longitudinal translation of the handle along the tube member from the holding end portion to the attachment end portion rotates the tube member about the longitudinal axis in a first rotational direction and resiliently deforms the first and second resilient biasing elements into preloaded states, and wherein the first and second resilient biasing elements comprise differing stiffnesses.

2. The apparatus of claim 1, further comprising a scrubbing element coupled to said attachment end portion such that said scrubbing element and said tube member are rotationally fixed.

3. The apparatus of claim 2, wherein the scrubbing element includes a through hole that extends therethrough and is in communication with the internal cavity, the through hole being configured to allow fluid and/or air to flow through.

4. The apparatus of claim 1, wherein the first resilient biasing element comprises a first spring with a first spring constant, and the second resilient biasing element comprises a second spring with a second spring constant that differs from the first spring constant.

5. The apparatus of claim 1, further comprising an engagement member positioned within the internal cavity, the engagement member engaged with the following pin portion and the first resilient biasing element.

6. The apparatus of claim 5, wherein the engagement member is spherical and the internal cavity is cylindrical.

7. The apparatus of claim 5, wherein the engagement member comprises a maximum width that is at least 70% of a minimum width of a least a portion of the internal cavity.

8. The apparatus of claim 5, wherein the first resilient biasing element directly engages the engagement member and the at least one guide element.

9. The apparatus of claim 1, wherein the at least one guide element comprises a first spherical member and the internal cavity is cylindrical.

10. The apparatus of claim 1, wherein the at least one guide element comprises a maximum width that is at least 70% of a minimum width of a least a portion of the internal cavity.

11. The apparatus of claim 1, wherein the second resilient biasing element directly engages the at least one guide element and the stop member.

12. The apparatus of claim 1, further comprising a flexible sheath coupled to the handle and the attachment end portion member that extends about an exterior of the tube member.

13. The apparatus of claim 1, wherein the handle comprises a manually engageable handle portion and a base portion that defines a first portion of the through hole.

14. The apparatus of claim 13, wherein the handle portion defines a second portion of the through hole, and wherein the handle portion is pivotably coupled to the base portion.

15. The apparatus of claim 14, wherein the handle portion defines a secondary through hole that is substantially coaxial with the first portion of the through hole of the base portion when the handle portion is orientation in a first angled arrangement with respect to the base portion, and wherein the second portion of the through hole is substantially coaxial with the first portion of the through hole when the handle portion is orientation in a first linear arrangement with respect to the base portion.

16. The apparatus of claim 1, wherein the stop member is configured to allow fluid and/or air to flow past the stop member.

17. The apparatus of claim 1, wherein the attachment end portion is void of the helical slot and includes at least one open aperture that extends between an inner surface of the tube member that defines the internal cavity and an exterior surface of the tube member that forms at least one unobstructed passageway extending between the internal cavity and the exterior surface.

18. The apparatus of claim 17, wherein the at least one open aperture is positioned between the stop member and an end of the attachment end portion.

19. The apparatus of claim 1, wherein user application of a first longitudinal force to the handle acting toward the attachment end portion, and user prevention of rotation of the handle about the longitudinal axis, effectuates the longitudinal translation of the handle along the tube member from the holding end portion to the attachment end portion, translation of the at least one guide element along the internal cavity and into the attachment end portion of the tube member, and deformation of the first resilient biasing element and the second resilient biasing element into a first preloaded state, and wherein, in the first preloaded state, the first resilient biasing element and the second resilient biasing element apply a second longitudinal force to the handle acting toward the holding end portion.

20. The apparatus of claim 19, wherein, when the first longitudinal force is not applied to the handle and the handle is prevented from rotating about the longitudinal axis, the second longitudinal force effectuates longitudinal translation of the handle along the tube member from the attachment end portion to the holding end portion.

* * * * *